US010161675B2

(12) United States Patent
Kobayashi et al.

(10) Patent No.: US 10,161,675 B2
(45) Date of Patent: Dec. 25, 2018

(54) NATURAL GAS LIQUEFACTION SYSTEM

(71) Applicant: CHIYODA CORPORATION, Yokohama-shi, Kanagawa (JP)

(72) Inventors: Kenichi Kobayashi, Machida (JP); Yasuhiro Yoda, Kawasaki (JP); Toshiya Momose, Chigasaki (JP); Takamasa Oba, Yokohama (JP)

(73) Assignee: CHIYODA CORPORATION, Kanagawa (JP)

( * ) Notice: Subject to any disclaimer, the term of this patent is extended or adjusted under 35 U.S.C. 154(b) by 0 days.

(21) Appl. No.: 15/532,764

(22) PCT Filed: Dec. 9, 2014

(86) PCT No.: PCT/JP2014/006141
§ 371 (c)(1),
(2) Date: Jun. 2, 2017

(87) PCT Pub. No.: WO2016/092593
PCT Pub. Date: Jun. 16, 2016

(65) Prior Publication Data

US 2017/0328631 A1 Nov. 16, 2017

(51) Int. Cl.
*F25J 1/02* (2006.01)
*F25J 1/00* (2006.01)

(52) U.S. Cl.
CPC ..... *F25J 1/0259* (2013.01); *F25J 1/0022* (2013.01); *F25J 1/0052* (2013.01); *F25J 1/0055* (2013.01);
(Continued)

(58) Field of Classification Search
CPC ..... F25J 1/0257; F25J 1/0258; F25J 1/0216; F25J 1/0022; F25J 2205/50; F25J 2205/02; F25J 2220/64; F25J 2220/68
See application file for complete search history.

(56) References Cited

U.S. PATENT DOCUMENTS 6,269,655 B1 * 8/2001 Roberts ..... F25J 1/0022 62/335
2006/0150671 A1 * 7/2006 Lijima ..... F25J 1/0022 62/612
2014/0053599 A1 * 2/2014 Byfield ..... F28B 1/06 62/611

FOREIGN PATENT DOCUMENTS

JP 2000180048 A 6/2000
JP 2005147568 A 6/2005
WO 2014103332 A1 7/2014

OTHER PUBLICATIONS

International Search Report of International Application No. PCT/JP2014/006141, dated Mar. 17, 2015, 4 pages.

* cited by examiner

*Primary Examiner* — Brian M King
(74) *Attorney, Agent, or Firm* — Armstrong Teasdale LLP

(57) ABSTRACT

A natural gas liquefaction system includes a piping rack for supporting a raw material gas transporting pipe for transporting the raw material gas; a pre-cooling heat exchanger for pre-cooling the raw material gas with a first refrigerant; a first refrigerant compressor for compressing the first refrigerant; a plurality of first air-cooled heat exchangers disposed on a top of the piping; a liquefier for liquefying the raw material gas which has been cooled by the pre-cooling heat exchanger, wherein the piping rack has a widened section along a part of a length of the piping rack, wherein the pre-cooling heat exchanger and the first refrigerant compressor are disposed on either side of the widened section of the piping rack, and are connected to each other via a first refrigerant transporting pipe extending in a direction intersecting a lengthwise direction of the piping rack for transporting the first refrigerant.

5 Claims, 3 Drawing Sheets

(52) U.S. Cl.
CPC ..... *F25J 1/0216* (2013.01); *F25J 1/0296* (2013.01); *F25J 2205/02* (2013.01); *F25J 2205/04* (2013.01); *F25J 2205/50* (2013.01); *F25J 2220/64* (2013.01); *F25J 2220/66* (2013.01); *F25J 2220/68* (2013.01); *F25J 2230/04* (2013.01)

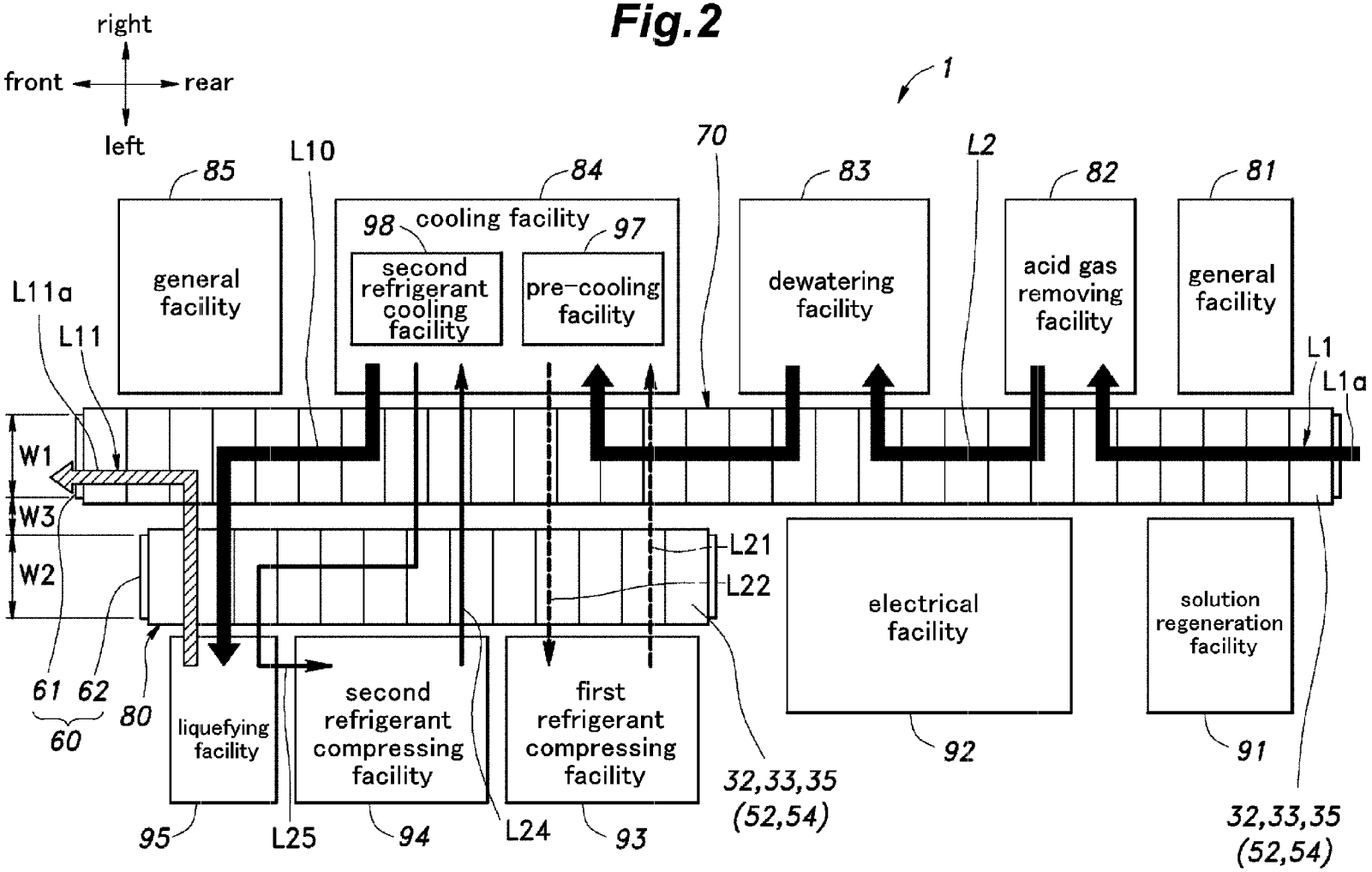
Fig.2
1
L1
L1a
32,33,35
(52,54)
81
general facility
82
acid gas removing facility
91
solution regeneration facility
L2
92
electrical facility
83
dewatering facility
70
L21
L22
32,33,35
(52,54)
84
cooling facility
97
pre-cooling facility
98
second refrigerant cooling facility
93
first refrigerant compressing facility
L24
94
second refrigerant compressing facility
L10
L25
85
general facility
95
liquefying facility
80
62
60
61
L11
L11a
W1
W3
W2
right
left
rear
front

NATURAL GAS LIQUEFACTION SYSTEM

CROSS-REFERENCE TO RELATED APPLICATIONS

This application is a U.S. National Phase Application of PCT/JP2014/006141, filed Dec. 9, 2014, the contents of which are hereby expressly incorporated by reference in their entirety.

TECHNICAL FIELD

The present invention relates to a natural gas liquefaction system for the liquefaction of natural gas for producing liquefied natural gas by cooling natural gas.

BACKGROUND ART

Natural gas obtained from gas fields is liquefied in a liquefaction plant so that the gas may be stored and transported in liquid form; that is, as an LNG. Cooled to around −162 degrees Celsius, the liquid natural gas advantageously has a significantly reduced volume as compared to gaseous natural gas, and is not required to be stored under a high pressure. Generally, a natural gas liquefaction process involves removing impurities such as moisture, acidic gas components and mercury contained in raw material gas (natural gas to be liquefied) in advance as necessary, and further involves, after removing heavy components (cyclohexane, benzene, toluene, xylene or the like) having a relatively high freezing point in order to prevent clogging of piping, facility and the like, liquefying the raw material gas comprised primarily of methane. Methods for cooling the raw material gas include what is called "Propane pre-cooled Mixed Refrigerant Method" which includes pre-cooling the raw material gas with propane refrigerant, and cooling (liquefying) the gas with mixed refrigerant (nitrogen, methane, ethane, propane and the like).

This type of liquefaction system is usually provided as a plant with comparatively high throughput and requires a relatively large installation area. JP2000-180048A (Patent Document 1) discloses a liquefaction system in which raw material gas is cooled without propane pre-cooling, thereby eliminating facilities related to propane refrigerant to minimize an installation area of the liquefaction system.

PRIOR ART DOCUMENT(S)

Patent Document(s)

Patent Document 1: JP2000-180048A

SUMMARY OF THE INVENTION

Task to be Accomplished by the Invention

Generally, known liquefaction systems as described above include a piping rack linearly arranged for supporting piping for transporting gas such as raw material gas or liquefied LNG, and raw material processing facilities disposed on either side of this piping rack where such facilities include an acid gas removing facility, a dewatering facility, a heavy component removing facility, a liquefying facility and other facilities.

When air-cooled heat exchangers are used for cooling a refrigerant (such as propane refrigerant, or mixed refrigerant) for cooling raw material gas, a group of air-cooled heat exchangers (hereinafter "air-cooled heat exchanger group") may be disposed on a top portion of the piping rack (at a relatively higher location) in order to prevent the air which has been used for cooling from affecting other facilities. With such a configuration, it is necessary to ensure a space for the installation of the piping rack having an area required at least for disposing an air-cooled heat exchanger group. However, an increase in the length or width of the piping rack can disadvantageously decrease the degree of freedom of installation of the liquefaction system (that is, it becomes more difficult to ensure a space necessary for the installation of the piping rack). In particular, since the width of the piping rack is determined according to the size of the air-cooled heat exchanger group to be disposed, an increase in the width of the piping rack (for example, the width of the piping rack is determined such that the air-cooled heat exchanger group arranged in one row in a lengthwise direction is replaced with the air-cooled heat exchanger group arrange in two rows) can cause a problem that the width of the whole piping rack becomes unnecessarily large (that is, areas on which no piping is supported is increased), resulting in reduced efficiency of space use for the piping rack. Furthermore, increasing the length and width of the piping rack leads to increasing the length of branch pipes and connecting pipes where the branch pipes branch off from the main piping supported by the piping rack and extend into respective facilities and the connecting pipes connect facilities arranged on both sides of the piping rack, which uneconomically increases the cost associated with refrigerant-related facilities.

On the other hand, as the known technology shown in the aforementioned Patent Document 1, it may also be possible to change the pre-cooling process such that some of facilities can be omitted to thereby ensure the degree of freedom of installation of the liquefaction system. However, this approach will not improve efficiency of space use for the piping rack and can cause another problem such as an increase in the cooling-related cost caused by the use of an alternative refrigerant.

The present invention has been made in view of such problems of the prior art, and a primary object of the present invention is to provide a natural gas liquefaction system in which an air-cooled heat exchanger group for cooling refrigerant used for cooling natural gas is disposed on a piping rack, which system allows the cost associated with refrigerant-related facilities to be reduced while minimizing a decrease in the degree of freedom of installation of the liquefaction system and a reduction in efficiency of space use for the piping rack.

Means to Accomplish the Task

A first aspect of the present invention provides a natural gas liquefaction system for cooling a natural gas supplied as a raw material gas to produce a liquefied natural gas, comprising: a piping rack for supporting a raw material gas transporting pipe for transporting the raw material gas; a pre-cooling heat exchanger for pre-cooling the raw material gas with a first refrigerant; a first refrigerant compressor for compressing the first refrigerant; a plurality of first air-cooled heat exchangers disposed on a top of the piping rack for cooling the first refrigerant compressed by the first refrigerant compressor; and a liquefier for liquefying the raw material gas by further cooling the raw material gas which has been cooled by the pre-cooling heat exchanger, wherein the piping rack has a widened section along a part of a length of the piping rack in a plan view, and wherein the pre-cooling heat exchanger and the first refrigerant compressor are disposed on either side of the widened section of the piping rack, and are connected to each other via a first refrigerant transporting pipe extending in a direction intersecting a lengthwise direction of the piping rack for transporting the first refrigerant.

In the natural gas liquefaction system according to the first aspect of the present invention, the first air-cooled heat exchangers are disposed on the top of the piping rack for cooling the refrigerant used for cooling the natural gas, and the pre-cooling heat exchanger and the first refrigerant compressor are disposed either side of the widened section. As a result, the system allows the first air-cooled heat exchangers to be collectedly arranged in a region adjacent to the pre-cooling heat exchanger and the first refrigerant compressor (the widened section), thereby enabling reduction of the length of the first refrigerant transporting pipe for transporting the refrigerant between the pre-cooling heat exchanger and the first refrigerant compressor. The system thus allows the cost associated with the first refrigerant-related facilities to be reduced while minimizing a decrease in the degree of freedom of installation of the liquefaction system and a reduction in efficiency of space use for the piping rack compared to a system which includes a piping rack having a constant width to ensure a space necessary for disposing the air-cooled heat exchangers (i.e. the piping rack has a rectangular shape having a constant length or width and does not have a widened section).

According to a second aspect of the present invention, in the system of the first aspect of the present invention, the piping rack comprises: a first rack (61) extending in the lengthwise direction, the first rack having a first width; and a second rack (62) extending adjacent to said first rack with a length shorter than the first rack to form the widened section, the second rack having a second width.

In the natural gas liquefaction system according to the second aspect of the present invention, the widened section is formed by the first rack which is a main rack and the second rack extending adjacent to the first rack. As a result, the system allows for an effective use of a space between the first and second racks and which increases the degree of freedom of arrangement of equipment and facilities in the system.

According to a third aspect of the present invention, in the system of the first or second aspect of the present invention, an upstream end portion (L1*a*) of the raw material gas transporting pipe is disposed on a first side in the lengthwise direction of the piping rack, and the liquefier is disposed on a second side opposite to the first side in the lengthwise direction of the piping rack.

In the natural gas liquefaction system according to the third aspect of the present invention, the system allows the raw material gas transporting pipe (main piping) to be disposed along the lengthwise direction of the piping rack (i.e. the system allows the raw material gas to be transported mainly in the lengthwise direction of the piping rack), thereby minimizing an increase in a space in the piping rack (or a width of the piping rack in a direction orthogonal to the lengthwise direction) required for the raw material gas transporting pipe to be disposed.

According to a fourth aspect of the present invention, in the system of the third aspect of the present invention, the widened section is located on the second side in the lengthwise direction of the piping rack.

In the natural gas liquefaction system according to the fourth aspect of the present invention, the system allows the pre-cooling heat exchanger, the refrigerant compressor, and the air-cooled heat exchanger to be disposed peripherally around the liquefier, thereby enabling reduction of the cost associated with first refrigerant-related facilities.

According to a fifth aspect of the present invention, in the system of any one of the first to fourth aspects of the present invention, the system further comprises a first gas-liquid separator (37) for the first refrigerant, wherein the first gas-liquid separator is disposed in the widened section.

In the natural gas liquefaction system according to the fifth aspect of the present invention, the system allows for an effective use of a redundant space (where any raw material gas transporting pipe and other equipment are not necessarily placed) in the widened section for disposing the first gas-liquid separator, thereby effectively minimizing a reduction in efficiency of space use for the piping rack and thus enabling reduction of the entire installation area of the liquefaction system even when the area for placement of the piping rack is increased to ensure a space necessary for the installation of the air-cooled heat exchangers.

According to a sixth aspect of the present invention, in the system of any one of the first to fifth aspects of the present invention, the system further comprises a second refrigerant compressor (51, 53) for compressing a second refrigerant used for cooling the raw material gas in the liquefier; a plurality of second air-cooled heat exchangers (52, 54) disposed on the top of the piping rack for cooling the second refrigerant compressed by the second refrigerant compressor; and a refrigerant heat exchanger (55, 56, 57) for cooling the second refrigerant with the first refrigerant; wherein the second refrigerant compressor and the refrigerant heat exchanger are disposed on either side of the widened section of the piping rack, and are connected to each other via a second refrigerant transporting pipe (L24, L25) extending in the direction intersecting the lengthwise direction for transporting the second refrigerant.

In the natural gas liquefaction system according to the sixth aspect of the present invention, the second refrigerant compressor and the refrigerant heat exchanger are disposed on either side of the widened section of the piping rack. As a result, the system allows the second air-cooled heat exchangers to be collectedly arranged in a region adjacent to the second refrigerant compressor and the refrigerant heat exchanger (the widened section), thereby enabling reduction of the length of the second refrigerant transporting pipe for transporting the refrigerant between the second refrigerant compressor and the refrigerant heat exchanger. This enables reduction of the cost associated with second refrigerant-related facilities.

According to a seventh aspect of the present invention, in the system of the sixth aspect of the present invention, the second refrigerant compressor is disposed adjacent to the first refrigerant compressor along one side of the piping rack, and the refrigerant heat exchanger is disposed adjacent to the pre-cooling heat exchanger along the other side of the piping rack.

In the natural gas liquefaction system according to the seventh aspect of the present invention, the system enables the efficient connection between the refrigerant compressors and the heat exchanges via the first and second refrigerant transporting pipes.

An eighth aspect of the present invention provides a natural gas liquefaction system for cooling a natural gas supplied as a raw material gas to produce a liquefied natural gas, comprising: a piping rack for supporting a raw material gas transporting pipe for transporting the raw material gas; a second refrigerant compressor for compressing a second refrigerant used for liquefying the raw material gas; a plurality of second air-cooled heat exchangers disposed on the top of the piping rack for cooling the second refrigerant compressed by the second refrigerant compressor; and a refrigerant heat exchanger for cooling the second refrigerant; wherein the second refrigerant compressor and the refrigerant heat exchanger are disposed on either side of the piping rack, and are connected to each other via a second refrigerant transporting pipe extending in the direction intersecting the lengthwise direction of the piping rack for transporting the second refrigerant.

In the natural gas liquefaction system according to the eighth aspect of the present invention, the refrigerant heat exchanger is disposed on the top of the piping rack for cooling the first refrigerant used for cooling the second refrigerant, and the second refrigerant compressor and the refrigerant heat exchanger are disposed either side of the widened section. As a result, the system allows the second air-cooled heat exchangers to be collectedly arranged in a region adjacent to the second refrigerant compressor and the refrigerant heat exchanger (the widened section), thereby enabling reduction of the length of the second refrigerant transporting pipe for transporting the refrigerant between the second refrigerant compressor and the refrigerant heat exchanger. The system allows the cost associated with the second refrigerant-related facilities to be reduced while minimizing a decrease in the degree of freedom of installation of the liquefaction system and a reduction in efficiency of space use for the piping rack compared to a system which includes a piping rack having a constant width to ensure a space necessary for disposing the second air-cooled heat exchanger.

According to a ninth aspect of the present invention, in the system of the eighth aspect of the present invention, the system further comprises a second gas-liquid separator (59) for the second refrigerant, wherein the first gas-liquid separator is disposed in the widened section.

In the natural gas liquefaction system according to the ninth aspect of the present invention, the system allows for an effective use of a redundant space (where any raw material gas transporting pipe and other equipment are not necessarily placed) in the widened section for disposing the second gas-liquid separator, thereby effectively minimizing a reduction in efficiency of space use for the piping rack and thus enabling reduction of the entire installation area of the liquefaction system even when the area for placement of the piping rack is increased to ensure a space necessary for the installation of the air-cooled heat exchangers.

Effect of the Invention

As can be appreciated from the foregoing, in the natural gas liquefaction system of the present invention in which an air-cooled heat exchanger group for cooling refrigerant used for cooling natural gas is disposed on a piping rack, the system allows the cost associated with refrigerant-related facilities to be reduced while minimizing a decrease in the degree of freedom of installation of the liquefaction system and a reduction in efficiency of space use for the piping rack.

BRIEF DESCRIPTION OF THE DRAWINGS

FIG. 2 is a diagram showing how primary facilities are located and how primary pipes are connected in the natural gas liquefaction system of the present invention.

DESCRIPTION OF THE PREFERRED EMBODIMENT(S)

Embodiments of the present invention are described in the following with reference to the appended drawings.

Figure 1:
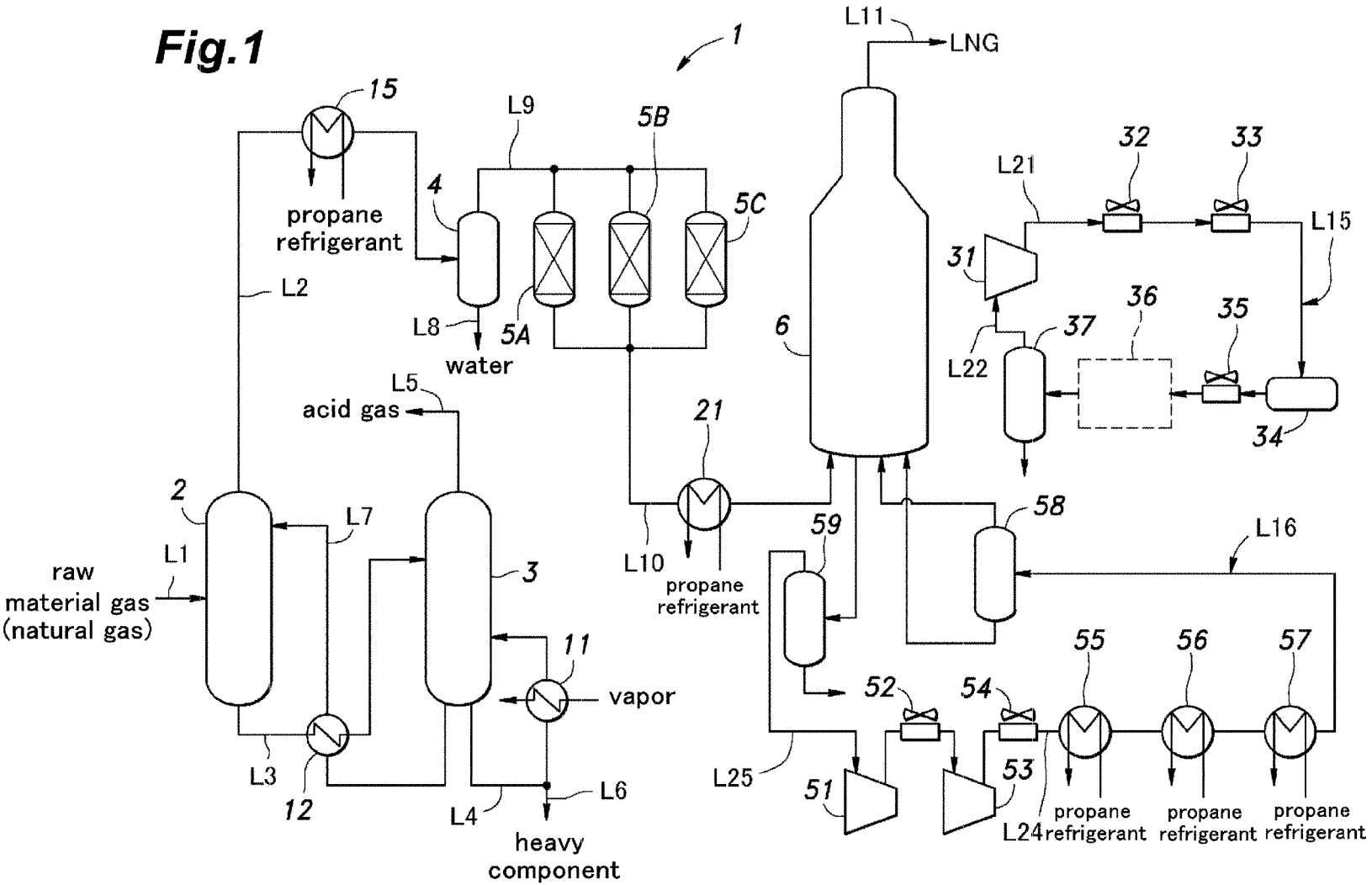
FIG. 1 is a schematic diagram of a natural gas liquefaction system in accordance with an embodiment of the present invention.

FIG. 1 is a schematic diagram of a natural gas liquefaction system in accordance with an embodiment of the present invention. FIG. 1 schematically illustrates respective pipes for transporting the raw material gas or other gases indicated by lines with arrows. The liquefaction system 1 is composed primarily of a liquefaction plant which cools raw material gas (natural gas to be liquefied) to produce liquefied natural gas (LNG). The liquefaction system 1 includes an absorption tower 2 for removing acid gases contained in the raw material gas, a regeneration tower 3 for regenerating an absorbing liquid (solution) used in the absorption tower 2, a gas-liquid separator 4 for performing gas-liquid separation to separate moisture contained in the raw material gas, moisture removers 5A to 5C for removing moisture contained in the raw material gas, and a liquefier 6 for liquefying the raw material gas from which unnecessary components (acidic gas, heavy components, moisture, mercury or the like) have been removed.

The absorption tower 2 is composed primarily of a shelf plate tower including shelves provided at regular intervals therewithin, and causes components to be removed (acid gases and heavy components, in this case) to be absorbed into the absorbing liquid by bringing the absorbing liquid into countercurrent contact with the raw material gas supplied via a raw material gas transporting pipe L1. The raw material gas from which the components to be removed have been removed in the absorption tower 2 is sent from the top of the tower to the gas-liquid separator 4 via a raw material gas transporting pipe L2. The absorbing liquid which has absorbed the components to be removed is sent to the regeneration tower 3.

The regeneration tower 3 is provided with shelves like the absorption tower 2, and treats the absorbing liquid at certain pressure and temperature to thereby separate the components to be removed from the absorbing liquid. In the regeneration tower 3, the absorbing liquid supplied from the absorption tower 2 drops within the tower from the upper part thereof via an absorbing liquid transporting pipe L3. Provided in a circulation pipe L4 connected to a bottom of the regeneration tower 3 is a reboiler 11, which serves as a heat source of the regeneration tower 3. The reboiler causes a part of the absorbing liquid discharged from the bottom of the tower 3 to be heated by heat exchange with a heat medium supplied from the outside of the reboiler 11, and then circulate in the regeneration tower 3. Acidic gas components such as carbon dioxide are recovered from a discharge pipe L5 connected to the top of the regeneration tower 3. Furthermore, heavy components (heavy hydrocarbons such as benzene) are recovered from a discharge pipe L6 branched from the circulation pipe L4 connected to the regeneration tower 3.

The configurations of the absorption tower 2 and the regeneration tower 3 are not limited to those described above, and other known configurations can be adopted.

The absorbing liquid from which the components to be removed have been separated in the regeneration tower 3 is supplied to an upper part of the absorption tower 2 again via an absorbing liquid transporting pipe L7. A heat exchanger 12 is provided between the absorbing liquid transporting pipe L3 and the absorbing liquid transporting pipe L7, and causes the absorbing liquid with a lower temperature flowing through the absorbing liquid transporting pipe L3 to be heated by heat exchange with the absorbing liquid with a higher temperature flowing through the absorbing liquid transporting pipe L7. After being cooled by the heat exchange, the absorbing liquid flowing through the absorbing liquid transporting pipe L7 is then supplied to the absorption tower 2.

The absorbing liquid is a mixed absorbent containing a certain ratio of known chemical absorbent such as carbon dioxide, hydrogen sulfide, mercaptan, or carbonyl sulfide that absorbs acidic gas components through a chemical reaction, and a certain ratio of known physical absorbent that physically absorbs heavy hydrocarbons (heavy components) such as benzene, toluene and xylene contained in the raw material gas. The absorbing liquid also contains a certain ratio of water.

After the components to be removed have been removed from the raw material gas in the absorption tower 2 until the concentration of the components to be removed in the gas reaches a prescribed level or less, the raw material gas is cooled by the pre-cooling heat exchanger 15 provided on the raw material gas transporting pipe L2 and then sent to the gas-liquid separator 4. In the pre-cooling heat exchanger 15, propane refrigerant is used to cool the raw material gas whereby moisture in the raw material gas is condensed and discharged to the outside from a discharge pipe L8 as a liquid phase component in the gas-liquid separator 4. The raw material gas separated as a gas phase component in the gas-liquid separator 4 is supplied to a plurality of moisture removers 5A to 5C via a raw material gas transporting pipe L9.

The moisture removers 5A to 5C are composed primarily of a dewatering tower filled with a known moisture absorbent which physically adsorbs moisture. In the moisture removers 5A to 5C, in order to prevent troubles caused by freezing or the like in subsequent liquefaction processes, dehydration processing is performed until water content in the raw material gas is reduced to a prescribed ratio or less. The raw material gas from which moisture has been removed in the moisture removers 5A to 5C is cooled by propane refrigerant in the pre-cooling heat exchanger 21 provided on a raw material gas transporting pipe L10, and then supplied to the liquefier 6.

In order to remove unnecessary components in the raw material gas before the raw material gas is supplied to the liquefier 6, the liquefaction system 1 may include not only the above-mentioned elements but also other known facilities. For example, the system may include, between the moisture removers 5A to 5C and the liquefier, a mercury removing facility (such as a fixed bed type adsorption tower filled with activated carbon) for removing mercury in the raw material gas and facilities (such as expander, scrubbing tower, compressor, and rectifier) for removing heavy components (e.g. component with a high freezing point such as benzene or component with a high boiling point such as C5+ hydrocarbons).

The liquefier 6 is a main heat exchanger which liquefies the raw material gas from which unnecessary components such as acid gases and heavy components have been removed, by heat exchange with a mixed refrigerant. The liquefier 6 include, but not limited to, a spool-wound type heat exchanger accommodated in a shell in which a heat transfer tube (tube bundle) for flowing a raw material gas and a mixed refrigerant is wound like a coil, and may include any other type of heat exchanger (e.g. a plate-fin type heat exchanger) as long as it can be used at least for liquefaction of the raw material gas. The raw material gas which has been liquefied by cooling in the liquefier 6 exhibits a low temperature (approximately −162° C.) and is sent to an LNG tank (not shown) for storage via an LNG transporting pipe L11. In order to facilitate the liquefaction treatment in the liquefier 6, the raw material gas supplied to the liquefier 6 may be pressurized by a known compressor or the like.

In the cooling/liquefying process of the raw material gas by the liquefaction system 1, what is called a Propane Pre-cooled Mixed Refrigerant Method is adopted in which a raw material gas is cooled (pre-cooled) with propane refrigerant and then cooled (liquefied) with a mixed refrigerant as described above. Thus, the liquefaction system 1 includes facilities for a propane pre-cooling system related to cooling by propane refrigerant and facilities for a mixed-refrigerant system related to cooling by a mixed refrigerant.

In the propane pre-cooling system, propane refrigerant (first refrigerant) which has been compressed in a refrigerant compressor (first refrigerant compressor) 31 is supplied to a refrigerant transporting pipe L21 and cooled and condensed by a plurality of air-cooled heat exchangers (first air-cooled heat exchangers) 32, 33 provided on the refrigerant transporting pipe L21, and then introduced into a refrigerant tank 34. Thereafter, the propane refrigerant is introduced into an air-cooled heat exchanger 35 to be further cooled and then supplied to pre-cooling heat exchangers 15 and 21 for pre-cooling the raw material gas and below-mentioned heat exchangers 55, 56 and 57 for cooling the mixed refrigerant (here, collectively referred to as a propane-refrigerant-cooling section 36) where the propane refrigerant is used for cooling the raw material gas or cooling the mixed refrigerant. The propane refrigerant discharged from the cooling-by-propane-refrigerant site 36 is introduced into a gas-liquid separator (here, a knockout drum) 37 where a separated gas phase component is again discharged via a refrigerant transporting pipe L22 back to the refrigerant compressor 31. Such circulation of the propane refrigerant is implemented by a plurality of pipes including the above-described refrigerant transporting pipes L21 and L22 connecting the respective elements and equipment in the propane pre-cooling system (here, collectively referred to as a first refrigerant circulation pipe L15). In FIG. 1, the facilities or equipment of the propane pre-cooling system is shown independently of the other facilities or equipment for clarity purposes.

In the mixed refrigerant system, after the mixed refrigerant is pressurized by a first-stage refrigerant compressor (second refrigerant compressor) 51, the mixed refrigerant is cooled by an air-cooled heat exchanger (second air-cooled heat exchanger) 52, and pressurized by a second-stage refrigerant compressor (second refrigerant compressor) 53, and then cooled by an air-cooled heat exchanger (second air-cooling type heat exchanger) 54. Thereafter, the mixed refrigerant is supplied to via a refrigerant transporting pipe L24 to be introduced into a series of cooling elements, i.e. the refrigerant heat exchangers 55, 56, 57 where the mixed refrigerant is further cooled by high pressure propane refrigerant, intermediate pressure propane refrigerant, and low pressure propane refrigerant, and then the mixed refrigerant is introduced into a refrigerant separator 58. After the mixed refrigerant is separated into a gas phase component and a liquid phase component in the refrigerant separator 58, the respective components are again introduced into the liquefier 6 where they are used for cooling the raw material gas. The mixed refrigerant discharged from the liquefier 6 is introduced into a gas-liquid separator (here, a knockout drum) 59, and a gas phase component separated in the gas-liquid separator is returned to the first-stage refrigerant compressor 51 via a refrigerant transporting pipe L25. As such, the circulation of the mixed refrigerant is implemented by using a plurality of pipes including the above-described refrigerant transporting pipes L24, L25 connecting each element and equipment (here, collectively referred to as a second refrigerant circulation pipe L16) in the mixed refrigerant system.

Note that the configurations of the refrigerant compressor 31, the air-cooled heat exchangers 32, 33, 35 and the propane-refrigerant-cooling section 36 in the propane pre-cooling system (e.g. the type, number, arrangement of each element or equipment) may be changed as appropriate. Similarly, the configurations of the refrigerant compressors 51 and 53, the air-cooled heat exchangers (second air-cooled heat exchangers) 52 and 54, and the refrigerant heat exchangers 55, 56, 57 and other elements in the mixed refrigerant system may be changed as appropriated. In FIG. 1, the pre-cooling heat exchanger 21 and the air-cooled heat exchangers 32, 33, 35, 52, and 54 are indicated as a single element denoted by a single reference numeral, respectively. However, each of the pre-cooling heat exchanger 21 and the air-cooled heat exchangers 32, 33, 35, 52, and 54 may be constituted by a plurality of heat exchangers. Likewise, each of the refrigerant compressors 31, 51, 53 can also be constituted by a plurality of compressors.

The mixed refrigerant includes, but not limited to one obtained by adding nitrogen to a hydrocarbon mixture containing methane, ethane, and propane, and any other known components can be adopted as the mixed refrigerant as long as the desired cooling effect can be achieved. Furthermore, the cooling system for cooling the raw material gas is not limited to the one described herein, and examples of adoptable cooling systems for cooling the raw material gas include a cascade system in which individual refrigeration cycles are formed by multiple types of refrigerants (such as methane, ethane, and propane) having different boiling points, a DMR (Double Mixed Refrigerant) system in which a mixed refrigerant such as a mixture of ethane and propane is used for a pre-cooling process, a Mixed Fluid Cascade (MFC) system in which heat exchange is performed step by step using different series of mixed refrigerants are used for pre-cooling, liquefaction, and supercooling cycles, respectively, to perform heat exchange by stages, and other known systems.

Examples of the raw material gas to be treated in the liquefaction system 1 include, but not limited to, natural gases obtained in a pressurized state from shale gas, tight sand gas, and coalbed methane. The raw material gas may be supplied to the liquefaction system 1 not only from a gas field or other natural source via a pipe, but also from a gas storage tank or any other storage for gas. The term "raw material gas" as used herein does not mean a gas in the strict sense of the word, but refers to any substance subject to liquefaction (including any substance to be treated during the process) in the liquefaction system 1.

Figure 3:
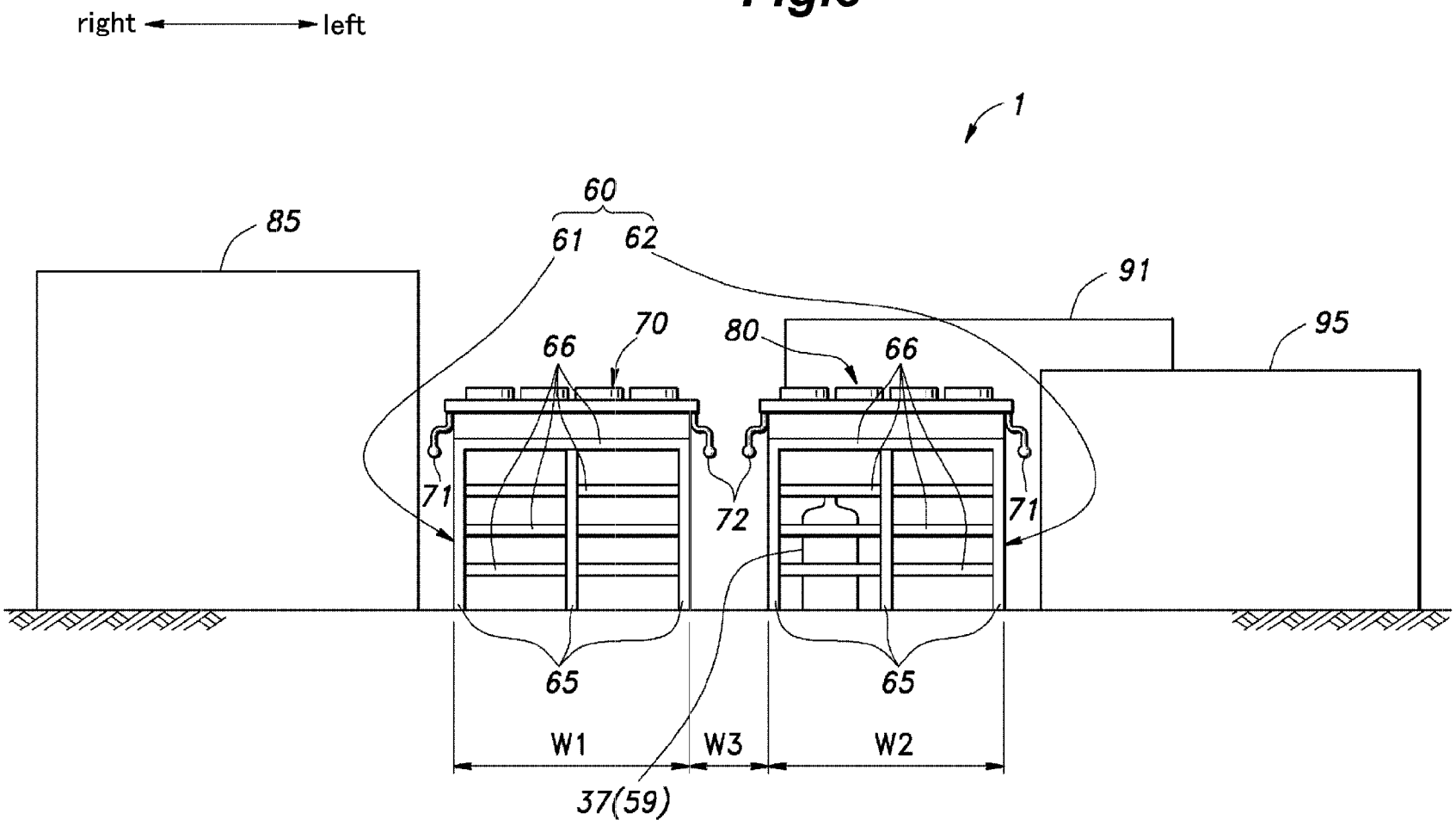
FIG. 3 is a diagram schematically illustrating a structure of a piping rack used in the natural gas liquefaction system of the present invention.

FIG. 2 is a schematic plan view showing the arrangement of primary facilities and the main pipe connections in liquefaction system 1, and FIG. 3 is a schematic side view schematically illustrating a structure of the piping rack 60 in the liquefaction system 1. The configuration of the liquefaction system 1 will be described with reference to FIG. 2, in which arrows indicate the front-rear direction and the right-left direction used in the description for the sake of convenience.

As shown in FIG. 2, the liquefaction system 1 includes the piping rack 60 for supporting piping used for transporting fluids including the raw material gas, various components separated from the raw material gas, refrigerants (such as propane refrigerant and mixed refrigerant) for cooling LNG or the raw material gas. The piping rack 60 includes a main rack (first rack) 61 linearly extending in the front-rear direction (longitudinal direction) with a prescribed width W1 (e.g. about 20 m), and a frame structure (second rack) 62 linearly extending along the main rack 61 with a prescribed width W2 (e.g., about 20 m). The main rack 61 and the frame structure 62 are arranged in parallel (substantially parallel) at a prescribed separation W3 (e.g., about 6 m).

The main rack 61 supports main piping with relatively large diameters such as the raw material gas transporting pipes L1, L2, L10 for transporting the raw material gas and the LNG transporting pipe L11 for transporting liquefied natural gas (LNG). As shown in FIG. 3, the main rack 61 includes a steel structure formed of a plurality of pillars 65 arranged at three points at certain intervals in the left-right direction, and a plurality of horizontal members 66 arranged at a plurality of locations in the vertical direction (which form four stages, in this case).

Although FIG. 2 schematically illustrates the arrangement (path) of the raw material gas transporting pipes L1, L2, L10 or other pipes by lines with arrows, respectively, actual pipes are supported by those structural members including the pillars 65 and horizontal members 66 and arranged in a more complicated manner than the arrangement shown in FIG. 2.

Although not shown in FIG. 3, other structural members such as lattices, trusses, and braces are provided on the main rack 61 as necessary in the same manner as known piping racks. The number and arrangement of the pillars 65 and the horizontal members 66 are not limited to the example shown in FIG. 3, and various modifications can be made.

An air-cooled heat exchanger group 70 for cooling refrigerants (propane refrigerant, and mixed refrigerant in this case) is arranged in the entire area of the top of the main rack 61 (substantially the entire upper surface of the main rack 61 in this case). The air-cooled heat exchanger group 70 is composed primarily of a plurality of air-cooled heat exchangers 32, 33, 35, 52, 54 arranged adjacent to each other in the front-rear direction. In the air-cooled heat exchanger group 70, headers 71, 72 for the air-cooled heat exchangers 32, 33, 35, 52, 54 are disposed on either side in the left-right direction of each piping rack, and the headers 71, 72 extend along the main rack 61 in the front-rear direction. The gap between the main rack 61 and the frame structure 62 is effectively utilized as a space for arranging the headers 72 on one side of each piping rack for the air-cooled heat exchangers 32, 33, 35, 52, 54.

The frame structure 62 is shorter than the main rack 61 in the front-rear direction and is disposed at a location along one side (a front side) of the main rack 61. The frame structure 62 has substantially the same structure as the main rack 61 except for the difference in the length in the front-rear direction. Due to the presence of this frame structure 62, the piping rack 60 has a widened section, in which the width or length in the left-right direction is widened, formed in a part of a length in the front-rear direction (in a part where the frame structure 62 is provided) of the piping rack. Like the air-cooled heat exchanger group 70 on the main rack 61, an air-cooled heat exchanger group 80 for cooling the refrigerant including a plurality of air-cooled heat exchangers 32, 33, 35, 52, 54 is arranged in the entire area of the top of the frame structure 62 (substantially the entire upper surface of the frame structure 62 in this case). This configuration allows the air-cooled heat exchangers 32, 33, 35, 52, 54 to be more collectedly arranged in the widened section of the piping rack 60 than in other parts of the length of the piping rack 60 (main rack 61) in the front-rear direction. However, all the air-cooled heat exchangers 32, 33, 35, 52, 54 are not necessarily disposed in the widened section of the piping rack 60, and in some cases, only some of the air-cooled heat exchangers 32, 33, 35, 52, 54 are selectively disclosed in the widened section and other are not.

In the present embodiment, the frame structure 62 has substantially the same structure as the main rack 61, but the structure of the frame structure 62 is not necessarily limited thereto. Unlike the main rack 61, the frame structure 62 substantially does not support the main piping extending in the front-rear direction. As a result, the frame structure 62 can be made, for example, to have the width W2 smaller than the width W1 of the main rack 61 (that is, the frame structure 62 can be made to have a smaller space which can support an object than the main rack 61). The separation in the front-rear direction between two adjacent pillars 65 of the frame structure 62 may be different from that of the main rack 61.

In the present embodiment, the piping rack 60 is constituted by the main rack 61 and the frame structure 62. In some embodiments, these elements may be integrally formed (for example, the main rack 61 may be integrally connected to the horizontal members 66 of the frame structure 62). In the latter case, a part of the main rack 61 is widened to the left so as to extend out in conformity to the width of the frame structure 62. However, providing the main rack 61 and the frame structure 62 separately as in the present embodiment is advantageous in that using these separate elements increases the degree of freedom of arrangement of equipment and facilities in the liquefaction system 1. In the present embodiment, the width W1 of the main rack 61 is the same as the width W2 of the frame structure 62. However, the respective widths W1 and W2 are not necessarily strictly constant along all the lengths in the front-rear direction of the main rack 61 and the frame structure 62.

In the liquefaction system 1, as shown in FIG. 2, facilities for liquefying the raw material gas are disposed on either side of the piping rack 60 such that the piping rack 60 is located between facilities disposed on both left and right sides. More specifically, on the right side of the piping rack 60, a first general facility 81, an acidic gas removing facility 82, a dewatering facility 83, a cooling facility 84, and a second general facility 85 are arranged in this order from the rear end side to the front end side of the piping rack 60. On the left side of the piping rack 60, a solution regeneration facility 91, an electrical facility 92, a first refrigerant compressing facility 93, a second refrigerant compressing facility 94, and a liquefying facility 95 are arranged in this order from the rear end side to the front end side of the piping rack 60.

The upstream end portion (inlet portion) L1*a* of the raw material gas transporting pipe L1 supported by the piping rack 60 is disposed at one end side (rear end side) of the piping rack 60, and the raw material gas is supplied to the acidic gas removing facility 82 via the raw material gas transporting pipe L1. The acidic gas removing facility 82 includes the absorption tower 2 shown in FIG. 1 and other apparatuses and equipment to be used in an acidic gas removing process. The solution regeneration facility 91 adjacent to the acidic gas removing facility 82 includes the regeneration tower 3 shown in FIG. 1 and other apparatuses and equipment to be used in the regeneration tower 3 and a process of regenerating the absorbing liquid (i.e. removing acidic gas components and the like) performed in the regeneration tower 3.

The raw material gas processed by the acidic gas removing facility 82 is supplied to the dewatering facility 83 via the raw material gas transporting pipe L2. The dewatering facility 83 includes the moisture removers 5A to 5C shown in FIG. 1 and other apparatuses and equipment to be used in a dewatering process performed in each moisture remover. The pre-cooling heat exchanger 15 and the gas-liquid separator 4 shown in FIG. 1 may be disposed in the dewatering facility 83.

The raw material gas processed by the dewatering facility 83 is supplied to the cooling facility 84 via the raw material gas transporting pipe L10. The cooling facility 84 is composed primarily of a pre-cooling facility 97 for cooling the raw material gas and a second refrigerant cooling facility 98 for cooling the mixed refrigerant. The pre-cooling facility 97 includes the pre-cooling heat exchanger 21 shown in FIG. 1 along with other apparatuses and equipment used for cooling the raw material gas in the pre-cooling heat exchanger 21, the air-cooled heat exchanger 33 and the refrigerant tank 34. The number and arrangement of the pre-cooling heat exchangers included in the pre-cooling facility 97 are not limited to those shown in the present embodiment and various modifications can be made thereto. The pre-cooling heat exchanger 15 as well as the pre-cooling heat exchanger 21 may be disposed in the pre-cooling facility 97. The second refrigerant cooling facility 98 includes the refrigerant heat exchangers 55, 56, 57 along with other apparatuses and equipment used for cooling the mixed refrigerant therewith. The raw material gas supplied to the cooling facility 84 is cooled to a prescribed temperature in the pre-cooling facility 97, and then is supplied to the liquefying facility 95 via the raw material gas transporting pipe L10.

The cooling facility 84 is disposed on one side of the widened section (a region where the main rack 61 and the frame structure 62 extend along each other to form a portion of the piping rack widened in the left and right direction) of the piping rack 60 so as to face the first refrigerant compressing facility 93 and the second refrigerant compressing facility 94. In the present embodiment, the pre-cooling facility 97 and the first refrigerant compressing facility 93 are disposed opposite to each other on either side of the widened section of the piping rack 60, and the second refrigerant cooling facility 98 and the second refrigerant compressing facility 94 are disposed opposite to each other on either side of the widened section of the piping rack 60.

The first refrigerant compressing facility 93 includes refrigerant compressor 31 of the propane pre-cooling system shown in FIG. 1 and other apparatuses and equipment used for compressing the propane refrigerant. The first refrigerant compressing facility 93 is connected to the cooling facility 84 (pre-cooling facility 97) via the refrigerant transporting pipes L21, L22 for transporting the propane refrigerant. The refrigerant transporting pipes L21, L22 constitute part of the first refrigerant circulation pipe L15 shown in FIG. 1 and extend in a direction intersecting a lengthwise direction (in this case, a direction substantially orthogonal to the lengthwise direction) of the piping rack 60. The propane refrigerant supplied to the cooling facility 84 via the refrigerant transporting pipe L21 is used for cooling the raw material gas and the mixed refrigerant and then circulated again to the first refrigerant compressing facility 93 via the refrigerant transporting pipe L22.

The gas-liquid separator 37 shown in FIG. 1 may be disposed in the widened section of the piping rack 60 (in this case, in the lower portion of the frame structure 62) as shown in FIG. 3. This configuration allows for an effective use of a redundant space (where any raw material gas transporting pipe such as the raw material gas transporting pipe L1, L2 or L3 and other equipment are not necessarily placed) in the widened section for disposing the gas-liquid separator 37, thereby effectively minimizing a reduction in efficiency of space use for the piping rack 60 and thus enabling reduction of the entire installation area of the liquefaction system 1 even when the area for placement of the piping rack 60 is increased to ensure a space necessary for the installation of the air-cooled heat exchangers.

The second refrigerant compressing facility 94 includes the refrigerant compressors 51, 53 of the mixed-refrigerant system shown in FIG. 1 and other apparatuses and equipment used for compressing the mixed refrigerant. The second refrigerant compressing facility 94 is connected to the second refrigerant cooling facility 98 via the refrigerant transporting pipes L24, L25 for transporting the mixed refrigerant. The refrigerant transporting pipes L24, L25 constitute part of the second refrigerant circulation pipe L16 shown in FIG. 1 and extend in the direction intersecting the lengthwise direction (in this case, a direction substantially orthogonal to the lengthwise direction) of the piping rack 60. The mixed refrigerant supplied to the cooling facility 84 via the refrigerant transporting pipe L24 is cooled by the propane refrigerant and then circulated again to the second refrigerant compressing facility 94 via the refrigerant transporting pipe L25. The mixed refrigerant flowing through the refrigerant transporting pipe L25 finally reaches the second refrigerant compressing facility 94 via the refrigerant separator 58 and the liquefier 6 shown in FIG. 1. Like the gas-liquid separator 37, the gas-liquid separator 39 shown in FIG. 1 may be disposed in the widened section of the piping rack 60 as shown in FIG. 3.

As described above, unlike the main rack 61, the frame structure 62 substantially does not support the main piping extending in the front-rear direction and thus provides a redundant space (including a ground surface under the frame structure 62). In the redundant space, not only the gas-liquid separator 37, 59 but also other apparatuses, equipment, containers and the like can be provided. As a result, the system allows for an effective use of a space in the piping rack 60. In addition, as the first refrigerant compressing facility 93 is connected to the cooling facility 84 (pre-cooling facility 97) via the refrigerant transporting pipes L21, L22 extending in the direction intersecting the lengthwise direction of the piping rack 60, piping extending in the front-rear direction between the first refrigerant compressing facility 93 and the cooling facility 84 becomes unnecessary (or can be reduced), thereby advantageously ensuring a space for maintenance such as maintenance of the air-cooled heat exchangers 32, 33, 35, 52, 54 arranged on the upper portion of the frame structure 62 (in this case, the top of the frame structure 62). The same advantage holds for the connection between the second refrigerant compressing facility 94 and the second refrigerant cooling facility 98 via the refrigerant transporting pipes L24 and L25.

The raw material gas which has been cooled in the cooling facility 84 is introduced into the liquefying facility 95 via the raw material gas transporting pipe L10. The liquefying facility 95 is disposed on the front end side of the piping rack 60. The liquefying facility 95 includes the liquefier 6 shown in FIG. 1 and other apparatuses and equipment used for liquefying the raw material gas by using the liquefier 6.

The second refrigerant compressing facility 94 includes the refrigerant compressors 51, 53 of the mixed-refrigerant system shown in FIG. 1 and other apparatuses and equipment used for compressing the mixed refrigerant. The second refrigerant compressing facility 94 is connected to the second refrigerant cooling facility 98 via the refrigerant transporting pipes L24, L25 for transporting the mixed refrigerant. The refrigerant transporting pipes L24, L25 constitute part of the second refrigerant circulation pipe L16 shown in FIG. 1 and extend in the direction intersecting the lengthwise direction (in this case, a direction substantially orthogonal to the lengthwise direction) of the piping rack 60. The mixed refrigerant supplied to the cooling facility 84 via the refrigerant transporting pipe L24 is cooled by the propane refrigerant and then circulated again to the second refrigerant compressing facility 94 via the refrigerant transporting pipe L25. The mixed refrigerant flowing through the refrigerant transporting pipe L25 finally reaches the second refrigerant compressing facility 94 via the refrigerant separator 58 and the liquefier 6 shown in FIG. 1. Like the gas-liquid separator 37, the gas-liquid separator 59 shown in FIG. 1 may be disposed in the widened section of the piping rack 60 as shown in FIG. 3.

The first general facility 81 includes an acidic gas combustion facility or other facilities disposed therein, and the second general facility 85 includes a rectifying facility or other facilities disposed therein. The electrical facility 92 includes a meter room (not shown) in which a control apparatus, a power supply and instrument displays are arranged.

Thus, in the liquefaction system 1, the air-cooled heat exchangers 32, 33, 35 are disposed on the top of the piping rack 60 for cooling the propane refrigerant, and (at least respective parts of) the pre-cooling heat exchanger 21 and the refrigerant compressor 31 are disposed either side of the widened section. As a result, the system allows the air-cooled heat exchangers 32, 33, 35 to be collectedly arranged in a region adjacent to the pre-cooling heat exchanger 21 and the refrigerant compressor 31 (the widened section), thereby enabling reduction of the lengths of the refrigerant transporting pipes L21, L22 or other pipes for transporting the propane refrigerant between the pre-cooling heat exchanger 21 and the refrigerant compressor 31. The system thus allows the cost associated with the propane-refrigerant-related facilities to be reduced.

Furthermore, in the liquefaction system 1, (at least respective parts of) the refrigerant compressors 51, 53 and the refrigerant heat exchangers 55, 56, 57 are disposed on either side of the widened section of the piping rack. As a result, the system allows the air-cooled heat exchangers 52, 54 to be collectedly arranged in a region adjacent to the refrigerant compressors 51, 53 and the refrigerant heat exchangers 55, 56, 57 (the widened section), thereby enabling reduction of the lengths of the refrigerant transporting pipes L24, L25 for transporting the mixed refrigerant between the refrigerant compressors 51, 53 and the refrigerant heat exchangers 55, 56, 57. The system thus enables reduction of the cost associated with mixed-refrigerant-related facilities.

Moreover, in the liquefaction system 1, the raw material gas transporting pipes (main piping) L1, L2, L10 are disposed along the lengthwise direction of the piping rack 60, the system can minimize an increase in a space in the piping rack 60 (or the width of the piping rack 60 in a direction orthogonal to the lengthwise direction) required for the raw material gas transporting pipes to be disposed.

In the present embodiment, the upstream side end portion L1*a* of the raw material gas transporting pipes L1, L2, L10 is disposed at one end side in the lengthwise direction of the piping rack 60, while the liquefier 6 (or the downstream end portion 11*a* of the LNG transporting pipe L11) is disposed on the other end side in the lengthwise direction of the piping rack 60. However, in other embodiments, the upstream side end portion L1*a* of the raw material gas transporting pipes L1, L2, L10 and the liquefier 6 (or the downstream end portion 11*a* of the LNG transporting pipe L11) may be disposed on the same end side (e.g. the rear end side in FIG. 2) of the piping rack 60.

In addition, in the liquefaction system 1, the widened section is located on the front side in the lengthwise direction of the piping rack 60, and the cooling facility 84, the first and second refrigerant compressing facilities 93, 94, and the air-cooled heat exchangers 32, 33, 35, 52, 54 are disposed peripherally around the liquefying facility 95. As a result, the system can effectively reduce the cost associated with facilities related to refrigerants (propane refrigerant, and mixed refrigerant).

Although the present invention has been described based on specific embodiments, these embodiments are merely exemplary and are not intended to limit the scope of the present invention. For example, the main rack may support at least a main part of the raw material gas transporting pipe, and may not necessarily support the entire raw material gas transporting pipe. In some example, the raw material gas transporting pipe and the LNG transporting pipe may be partially supported by the frame structure. In alternative embodiments, the main rack and the frame structure can support neither of the raw material gas transporting pipe and the LNG transporting pipe. Although two types of refrigerants are used in the above-described embodiments, a single refrigerant may be used or three or more types of refrigerants may be used. Usable refrigerants are not limited to the propane refrigerant and the mixed refrigerant used in the above embodiments, and any other known refrigerant can be used. Processing systems in respective facilities arranged on either side of the piping rack are not limited to those in the above embodiment, and any other known system (apparatus) can be adopted. All the elements of the liquefaction system of natural gas according to the present invention shown in the above embodiments are not necessarily essential and can be appropriately selected as long as they do not deviate from at least the range of the present invention.

Glossary

1 liquefaction system
2 absorption tower
3 regeneration tower
4 gas-liquid separator
5A, 5B, 5C moisture remover
6 liquefier
15 pre-cooling heat exchanger
21 pre-cooling heat exchanger
31 refrigerant compressor (first refrigerant compressor)
32, 33, 35 air-cooled heat exchanger (first air-cooled heat exchanger)
37 gas-liquid separator
51, 53 refrigerant compressor (second refrigerant compressor)
52, 54 air-cooled heat exchanger (second air-cooled heat exchanger)
55-57 refrigerant heat exchanger
58 refrigerant separator
59 gas-liquid separator
60 piping rack
61 main rack (first rack)
62 frame structure (second rack)
70, 80 air-cooled heat exchanger group
82 acid gas removing facility
83 dewatering facility
84 cooling facility
91 solution regeneration facility
92 electrical facility
93 first refrigerant compressing facility
94 second refrigerant compressing facility
95 liquefying facility
97 pre-cooling facility
98 second refrigerant cooling facility
L1, L2, L10 raw material gas transporting pipe
L11 LNG transporting pipe
L21, L22 refrigerant transporting pipe (first refrigerant transporting pipe)
L24, L25 refrigerant transporting pipe (second refrigerant transporting pipe)

The invention claimed is:

1. A natural gas liquefaction system for cooling a natural gas supplied as a raw material gas to produce a liquefied natural gas, comprising:

a piping rack for supporting a raw material gas transporting pipe for transporting the raw material gas;

a pre-cooling heat exchanger for pre-cooling the raw material gas with a first refrigerant;

a first refrigerant compressor for compressing the first refrigerant;

a plurality of first air-cooled heat exchangers disposed on a top of the piping rack for cooling the first refrigerant compressed by the first refrigerant compressor;

a liquefier for liquefying the raw material gas by further cooling the raw material gas which has been cooled by the pre-cooling heat exchanger;

a second refrigerant compressor for compressing a second refrigerant used for cooling the raw material gas in the liquefier;

a plurality of second air-cooled heat exchangers disposed on the top of the piping rack for cooling the second refrigerant compressed by the second refrigerant compressor; and a refrigerant heat exchanger for cooling the second refrigerant with the first refrigerant;

wherein the piping rack defines a length measured in a lengthwise direction and has a widened section along a part of the length of the piping rack, the widened section having a first width measured in a crosswise direction perpendicular to the lengthwise direction in a plan view between a first side of the piping rack and a second side of the piping rack, the first width being greater than a second width of another part of the length of the piping rack, wherein the pre-cooling heat exchanger and the first refrigerant compressor are disposed opposite to each other in the crosswise direction across the widened section of the piping rack, and are connected to each other via a first refrigerant transporting pipe extending across the widened section for transporting the first refrigerant, wherein the second refrigerant compressor and the refrigerant heat exchanger are disposed opposite to each other in the crosswise direction across the widened section of the piping rack, and are connected to each other via a second refrigerant transporting pipe extending across the widened section for transporting the second refrigerant, and wherein the second refrigerant compressor is disposed adjacent to the first refrigerant compressor along the first side of the piping rack, and the refrigerant heat exchanger is disposed adjacent to the pre-cooling heat exchanger along the second side of the piping rack.

2. The natural gas liquefaction system according to claim 1, wherein the piping rack comprises:

a first rack extending in the lengthwise direction, the first rack having a first rack width; and a second rack extending adjacent to said first rack with a length shorter than the first rack to form the widened section, the second rack having a second rack width.

3. The natural gas liquefaction system according to claim 1, wherein an upstream end portion of the raw material gas transporting pipe is disposed on a first side in the lengthwise direction of the piping rack, and wherein the liquefier is disposed on a second side opposite to the first side in the lengthwise direction of the piping rack.

4. The natural gas liquefaction system according to claim 3, wherein the widened section is located on the second side in the lengthwise direction of the piping rack.

5. The natural gas liquefaction system according to claim 1, further comprising:

a first gas-liquid separator for the first refrigerant; and a second gas-liquid separator for the second refrigerant, wherein at least one of the first gas-liquid separator and the second gas-liquid separator are disposed in the widened section.

* * * * *